US005144474A

United States Patent [19]

Keable et al.

[11] Patent Number: 5,144,474

[45] Date of Patent: Sep. 1, 1992

[54] PERFORATED PROCESSING APPARATUS AND METHOD

[75] Inventors: John B. Keable, Knoxville, Tenn.; Steve Bostic, Atlanta, Ga.

[73] Assignee: Delphi Technology, Inc., Atlanta, Ga.

[21] Appl. No.: 442,193

[22] Filed: Nov. 28, 1989

Related U.S. Application Data

[63] Continuation-in-part of Ser. No. 330,112, Mar. 29, 1989.

[51] Int. Cl.[5] ..... G03D 5/00

[52] U.S. Cl. ..... 354/319; 354/324

[58] Field of Search ..... 354/317, 319, 320, 321, 354/322, 324, 325; 134/64 P, 122 P

[56] References Cited

U.S. PATENT DOCUMENTS

| | | | |
|---|---|---|---|
| 1,928,235 | 9/1933 | Taylor . | |
| 2,404,138 | 7/1946 | Mayer . | |
| 2,587,350 | 2/1952 | Maiwald | 354/317 X |
| 2,677,320 | 5/1954 | Coughlin | 354/317 |
| 3,610,131 | 10/1971 | Frick et al. . | |
| 3,635,144 | 1/1972 | Beck . | |
| 3,643,628 | 2/1972 | Sugarman et al. . | |
| 3,687,708 | 8/1972 | Miller . | |
| 3,727,578 | 4/1973 | Saito et al. | 354/317 X |
| 3,752,054 | 8/1972 | Scanlan . | |
| 3,774,521 | 11/1973 | Beck . | |
| 3,873,988 | 5/1975 | Pfeifer et al. . | |
| 3,940,782 | 2/1976 | Neeb et al. . | |
| 4,142,194 | 2/1979 | Hamlin . | |
| 4,142,790 | 3/1979 | Neeb et al. . | |
| 4,145,135 | 3/1979 | Sara . | |
| 4,148,274 | 4/1979 | Stievenart et al. . | |
| 4,327,987 | 5/1982 | Friar et al. . | |
| 4,332,454 | 6/1982 | Hensel et al. . | |
| 4,421,399 | 12/1983 | Steube . | |
| 4,736,222 | 4/1988 | Stromberg . | |
| 4,758,858 | 7/1988 | Blackman et al. . | |
| 4,845,019 | 6/1989 | Vaughan | 354/319 X |
| 4,945,934 | 8/1990 | Vaughan | 354/317 X |

FOREIGN PATENT DOCUMENTS

| | | |
|---|---|---|
| 0033511 | 8/1912 | European Pat. Off. . |
| 1962441 | 12/1969 | Fed. Rep. of Germany . |
| 649724 | 6/1985 | Switzerland . |

OTHER PUBLICATIONS

Stong, C. L., "Kitchen-Sink Aerodynamics," *The Scientific American*, pp. 432–438 (1960).

*Primary Examiner*—A. A. Mathews

*Attorney, Agent, or Firm*—Kilpatrick & Cody

[57] ABSTRACT

A substantially closed processing station designed to disperse chemicals for uniformly coating or otherwise contacting an emulsion-coated or other surface is disclosed. The station includes opposed chemical chambers, each of which is covered with a perforated film and, optionally, a screen-like material, between which materials the photographic film or other substrate passes. Distension of the upper perforated film ensures contact between the film (or the screen) and the photographic film moving through the station while minimizing the pressure on and resulting abrading of the substrate's surface. Because the matched peripheries of the upper and lower chambers are closely fitted, the processing station is virtually sealed from the surrounding atmosphere and little degradation of the processing chemicals occurs even after extended periods of nonuse.

23 Claims, 7 Drawing Sheets

PERFORATED PROCESSING APPARATUS AND METHOD

CROSS-REFERENCE TO RELATED APPLICATION

This application is a continuation-in-part of application Ser. No. 07/330,112, filed Mar. 29, 1989, entitled "Automated, Interactive Vending System for Products Which Must be Processed," which application is incorporated herein in its entirety by this reference.

FIELD OF THE INVENTION

The present invention relates to applying liquid coatings to advancing substrates and more particularly to processing emulsive photosensitive materials.

BACKGROUND OF THE INVENTION

Processing photosensitive materials such as photographic film typically involves multiple steps such as developing, bleaching, fixing, rinsing, and drying the film. Because performance of these steps is well-suited for mechanization, various systems have been designed to convey long strips of film through a series of stations. Each station contains a liquid appropriate to the step to be performed at that station, with the differing liquids contacting the filmstrip sequentially as it is conveyed through the series.

The uniformity and overall quality of the processing operation is dependent upon a number of factors, including the precision with which the liquids are applied to the filmstrip, the integrity of the chemicals used, and the effectiveness of the means by which the filmstrip is protected from abrasions or other damage as it passes through the stations. U.S. Pat. No. 4,327,987 to Friar, et al., for example, discloses a mechanized processor designed to improve the transverse and longitudinal uniformity of the processed product. The processor uses a foraminous sheet of stainless steel screening positioned above the filmstrip to spread a layer of developing solution evenly across the film. The developing solution flows down a ramp until it pools on the film in an area adjacent the screen. As the film travels through the applicator the pool is compressed between the film and screen and forced away from the center of the filmstrip and toward the edges.

U.S. Pat. No. 4,332,454 to Hensel, et al. describes an applicator assembly designed both to coat the filmstrip uniformly with processing fluid and to clean its surface in a relatively gentle manner. The applicator includes an open-celled scrubber pad similar to a sponge positioned above and pressed against the film to be processed. As the film moves through the applicator, developing fluid is pumped through the scrubber pad to form a thin layer between the pad and filmstrip. Oscillation of the scrubber pad helps disperse the fluid across the entire width of the filmstrip as it removes unwanted particles. According to the Hensel, et al. patent, abrasions to the film are lessened in relation to prior systems because the pressure of the scrubber pad against the film is decreased.

While the above-mentioned film processors represent advances over traditional apparatus, a need remains for an automated system capable of providing high quality developing while maintaining the freshness of the processing chemicals over long periods of time and with intermittent utilization. Such an improved apparatus would be suitable for use in automated film processing systems as described in patent application Ser. No. 07/330,112, which function optimally when service requirements are minimized. In order for these systems to be commercially acceptable, uniform processing with minimal surface degradation of the processed film through scratching or abrading also is necessary.

SUMMARY OF THE INVENTION

The present invention provides a substantially closed processing station designed to disperse chemicals for uniformly coating or otherwise contacting an emulsive or other surface. The station includes opposed chemical chambers, each of which is covered with a perforated film and, optionally, a mesh or screen-like material, between which materials the photographic print paper or film or other substrate passes. Liquid chemical solutions, mixtures, or suspensions pass into the upper chamber through a central opening and from the chamber through the perforated film onto the film surface or onto the upper screen. The liquid then passes through the upper screen if such is present and is dispersed uniformly across the substrate surface.

As the chemicals enter the upper chamber and press against the upper film it distends about its center, ensuring contact between the perforated film (or the mesh or screen) and the photographic film or other material moving through the station while minimizing the pressure on (and resulting abrading of) the substrate's surface. Excess chemicals continuously puddle beneath and beside the processed material on the lower screen to reduce friction between the material and the lower chamber. Because the station is virtually sealed from the surrounding atmosphere by the close fit between the matched peripheries of the upper and lower chambers, little degradation of the processing chemicals occurs as a result of exposure to air, even after extended periods of nonuse. Furthermore, the small volume of chemicals required to fill the processing station allows the station to be flushed quickly and with a similarly small volume of chemicals and ensures that most of the fluids in the apparatus are in its chemical reservoir rather than in processing trays or tanks if operation is interrupted.

It is therefore an object of the present invention to provide a system for rapidly dispersing fluids uniformly onto a surface of an advancing substrate.

It is an additional object of the present invention to provide a system for ensuring but minimizing contact between an advancing substrate and a foraminous surface through which fluid will pass onto the substrate.

It is another object of the present invention to provide a system for minimizing abrasions to both surfaces of an advancing substrate.

It is yet an additional object of the present invention to provide a system for maintaining the integrity of any chemicals to be used to contact an advancing substrate over long periods of time.

Other objects, features, and advantages of the present invention will become apparent with reference to the remainder of the written portion and the drawings of this application.

DETAILED DESCRIPTION OF THE DRAWINGS

Figure 1A:
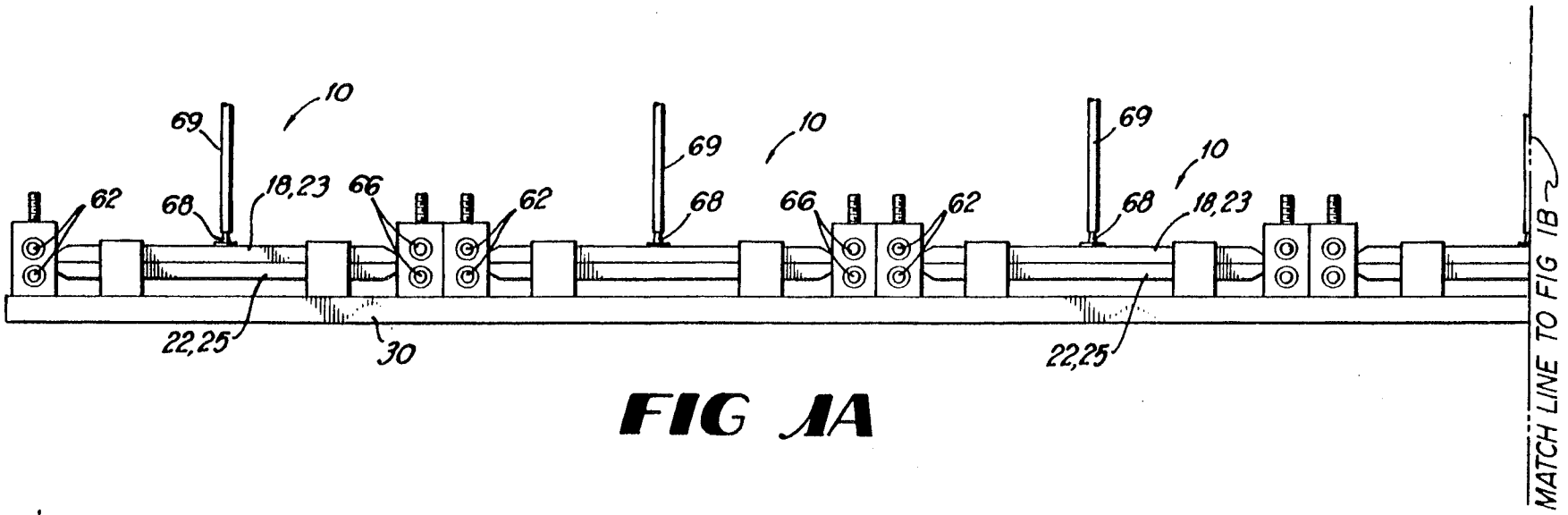
FIG. 1A–B is a schematic representation of a series of processing stations in a photographic film or print processing apparatus of the present invention.
Figure 1B:
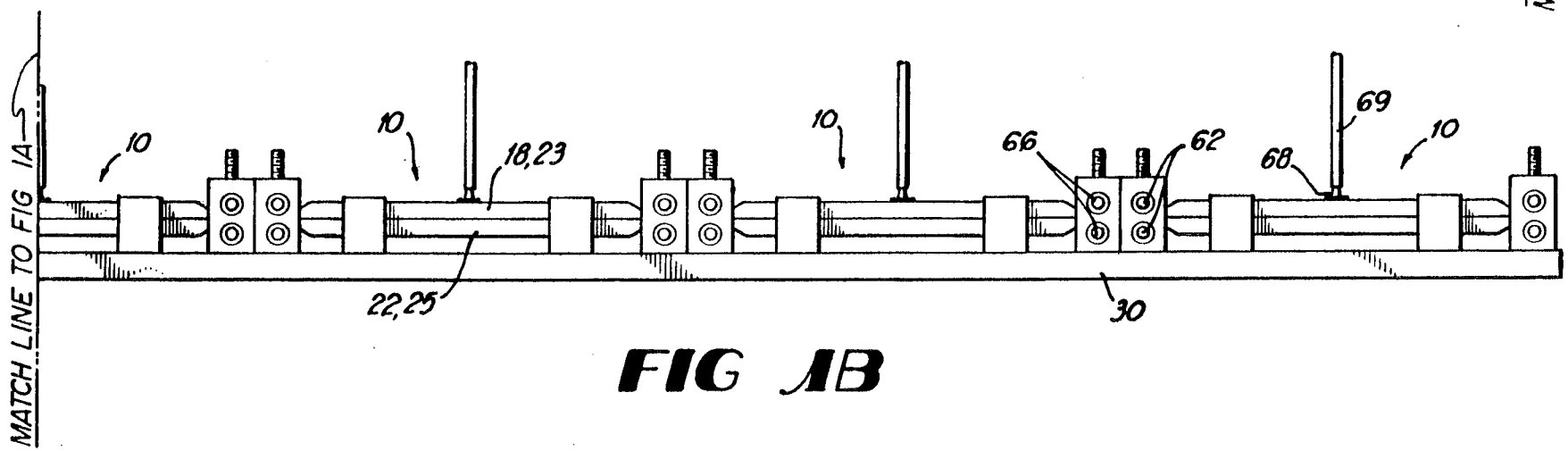
Figure 2:
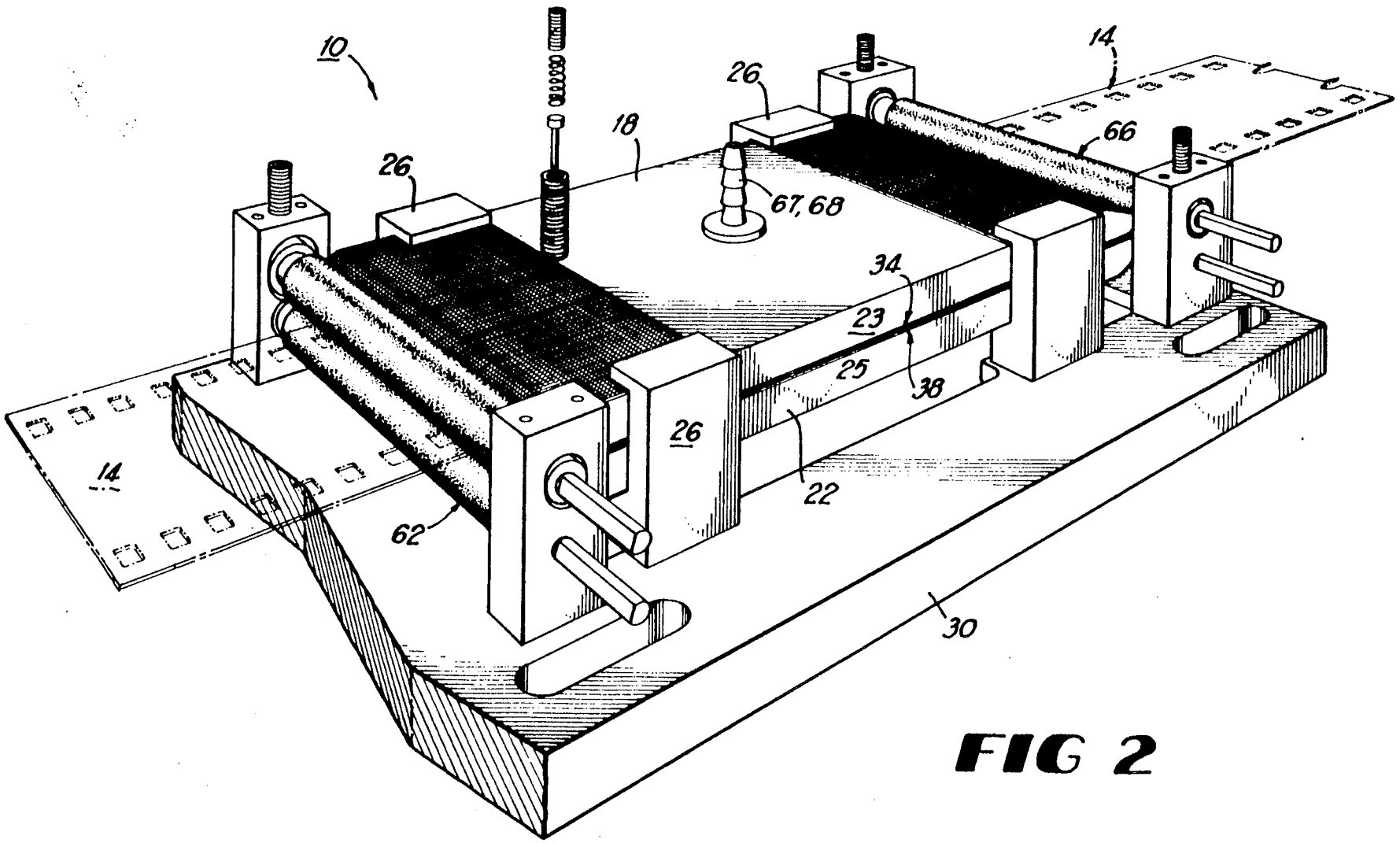
FIG. 2 is a perspective view of a single processing station of FIG. 1.
Figure 3:
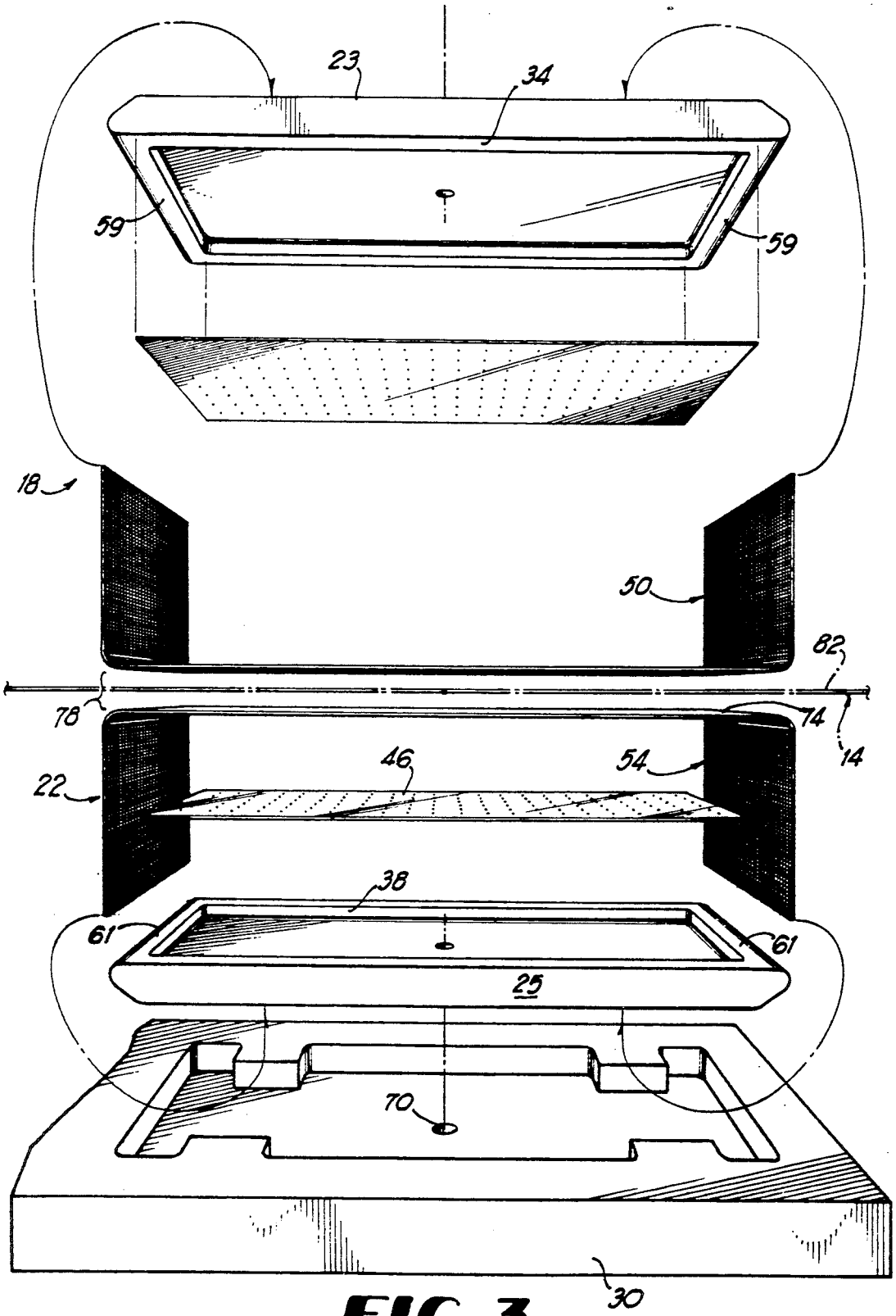
FIG. 3 is an exploded perspective view of the processing station of FIG. 2.
Figure 4:
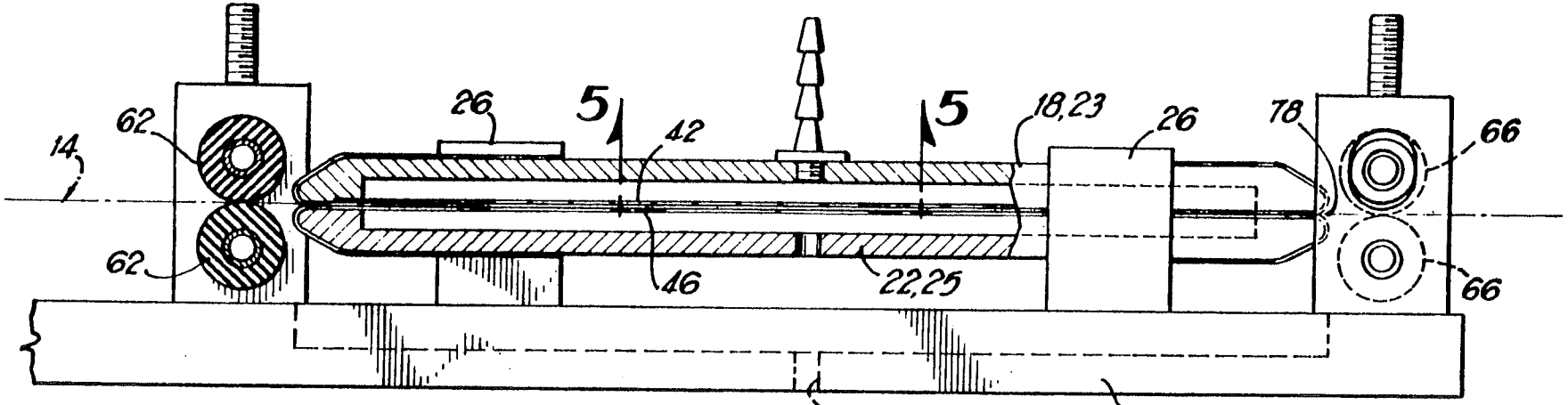
FIG. 4 is a side elevational view of the processing station of FIG. 2.
Figure 5:
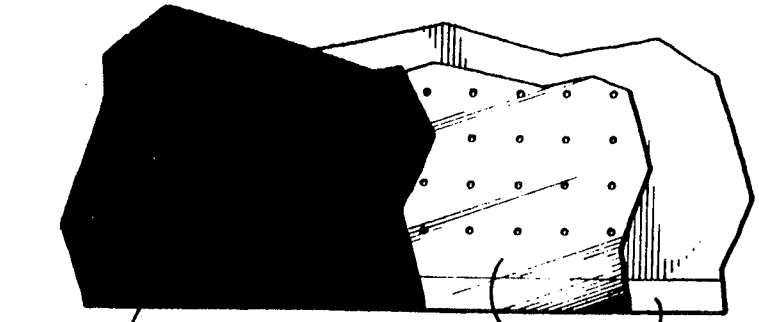
FIG. 5 is a plan view of the foraminous material of the processing station of FIG. 2 taken along lines 5-5 of FIG. 4 and shown partially cut-away.

FIG. 1 details a series of processing stations 10 through which an emulsion-bearing substrate or strip 14 (FIG. 2) such as photographic print paper or film, x-ray film, or graphics arts material passes during development. As shown in FIGS. 2-4, each processing station 10 includes opposed chemical chambers 18 and 22, respectively comprised of cells or trays 23 and 25 positioned above and below the path of travel of strip 14. Brackets or other conventional means 26 mount the upper and lower chambers 18 and 22 to base 30 while maintaining the peripheries 34 and 38 of the cells 23 and 2 in close proximity to each other. Chambers 18 and 22 also include perforated films 42 and 46 (FIGS. 3 and 5), which respectively form the bottom of upper cell 23 and the upper surface of lower cell 25. In one embodiment, processing station 10 also includes opposing screen or mesh sections 50 and 54 interposed between the peripheries 34 and 38 of cells 23 and 25. As shown in FIGS. 2-3, mesh sections 50 and 54 may extend beyond the peripheries 34 and 38 of cells 23 and 25, in which case their ends 58 may be wrapped around the cell ends 59 and 61 and secured to the cells 23 and 25 to form smooth surfaces and not interfere with the movement of strip 14.

Any appropriate conveying means may be used to cause strip 14 to travel sequentially through the series of processing stations !0 in FIG. 1. For example, a self-threading system of the type used in a photographic processing minilab leader tab system may be used to feed the strip 14 to the counter-rotating entry nip rollers 62 (FIGS. 2 and 4) of the first processing station 10 and each set of entry and exit nip rollers 62 and 66 may be driven by suitable motors. Similarly, any appropriate means may be utilized to cause the necessary processing fluid to flow into opening 67 through nipple 68 of each chemical chamber 18. If fluids are stored in remote tanks and connected to nipples 68 via appropriate tubing 69, for example, a metering pump or flow valve may be placed in-line to allow and control the flow of fluids through each nipple 68 into chamber 18.

Once fluid enters upper chamber 18, it spreads throughout the chamber and passes through the perforations of film 42 onto and through mesh section 50. In regions where strip 14 does not block movement of the fluid, some of the fluid will pass through mesh section 54 and perforated film 46 into lower cell 25, from which it may be drained through opening or drain 70. The remainder of the fluid will puddle on the upper surface 74 of lower mesh section 54 and serve as a lubricant to facilitate travel of strip 14 and minimize damage to its non-emulsive surface. Alternatively, drain 70 may be omitted, in which case fluid will collect in cell 25 and eventually seep out between the peripheries 34 and 38 of cells 23 and 25 into, for example, a pan or other collection means located beneath the station 10.

After passing through entry nip rollers 6 strip 14 is fed into a small gap 78 (slightly wider than the thickness of the 10 strip 14 and best seen in FIG. 4) between cells 23 and 25 and their associated mesh sections 50 and 54. Because only a small gap 78 exists between the peripheries 34 and 38 of the cells 23 and 25, processing system 10 is virtually sealed from the surrounding environment, thereby preventing significant quantities of air from contacting and degrading the quality of chemicals in the processing station 10 or interfering with the photographic processing accomplished. As fluid continues to pass through the perforations of film 42 and mesh section 50 it is dispersed uniformly onto and across the emulsion-coated surface 82 of strip 14. Additional fluid passing through perforations in film 42 not immediately above a portion of strip 14 will puddle on mesh section 54 to the sides of and beneath the strip, again serving as lubricants for the travel of the strip 14. The presence of fluid in upper chamber 18 also causes perforated film 42 and mesh section 50 to distend about the center of the cell 23, ensuring contact between mesh section 50 and the emulsion-coated surface 82 of strip 14 and agitating the emulsion while minimizing the pressure on and resulting abrading of the surface 82. Strip 14 then exits processing system 10 between counter-rotating exit nip rollers 66 and proceeds to the processing station 10 next in sequence.

If multiple inlets or feeds are provided in connection with upper chamber 18, the upper chamber 18 may be divided into two or more cells 23, thereby allowing repeated applications of fresh or different chemicals to strip 14 within the same chamber. Lower chamber 22 similarly may be divided into multiple cells if desired. The substantially continuous introduction of chemicals to and rapid removal of chemicals from strip 14 as it travels the length of each station 10 (whether having one each or more of cells 23 and 25) prevents residual waste materials and chemical reaction by-products from remaining on the emulsion-coated surface 82 of strip 14 for long periods of time.

In one embodiment of the present invention each of cells 23 and 25 is made of rigid PVC and has dimensions 5.875" × 2.25" × 0.25". Nipple 68 may be of appropriate size for connection to a 0.125" hose or tube serving as tubing 69. Perforated films 42 and 46 may be made of 8 mil polyester sheeting such as Mylar TM, with the perforations evenly spaced at 0.25" intervals throughout the length and width of the films. Saatilene TM or other similar mesh used in screen printing provides a suitable material for screen or mesh sections 50 and 54. Finally, although FIG. 1 shows a series of seven processing stations !0, one embodiment for processing photographic film utilizes twelve stations, six of which supply developer to the photographic film and the other six of which furnish fixer, bleach, and stabilizer (two stations each). Those skilled in the art will recognize, however, that these numbers, materials, and dimensions are not critical to the invention and may be varied while achieving the objectives of the present invention.

Figure 6:
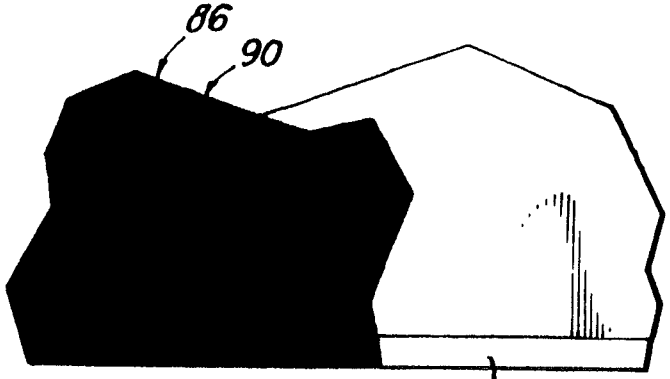
FIG. 6 is a plan view of an alternative material for the processing station FIG. 2 shown partially cut-away.

FIG. 6 details a single material 86 which may be used as an alternative to either or both of the upper and lower combinations of perforated films 42 and 46 and mesh segments 50 and 54. As illustrated in FIG. 6, material 86 consists of a perforated film having cross-hatching embossed on the surface 90 which contacts strip 14. If a substantially rigid but distendable and non-abrasive fluorinated polymer film such as Teflon TM film is chosen for material 86, processing of photographic film may be performed with minimal scratching or other damage. In this embodiment the Teflon TM material 86 may be 8–10 mil thick, with approximately 2 mil deep cross-hatching embossed on surface 90 (approximately 32–64 lines per inch) using a knurling tool, and may be solvent welded or heat welded to cells 23 and 25. The embossed cross-hatching on surface 90 used as an alternative to film 42 and mesh segment 50 assists in spreading processing fluid uniformly across the emulsion-coated side 82 of strip 14. If Teflon TM material 86 is used to replace perforated film 46 and mesh segment 54 associated with lower cell 25, cross-hatched embossing of surface 90 may facilitate the puddling of fluid beneath strip 14 and its resulting lubrication.

Figure 7A:
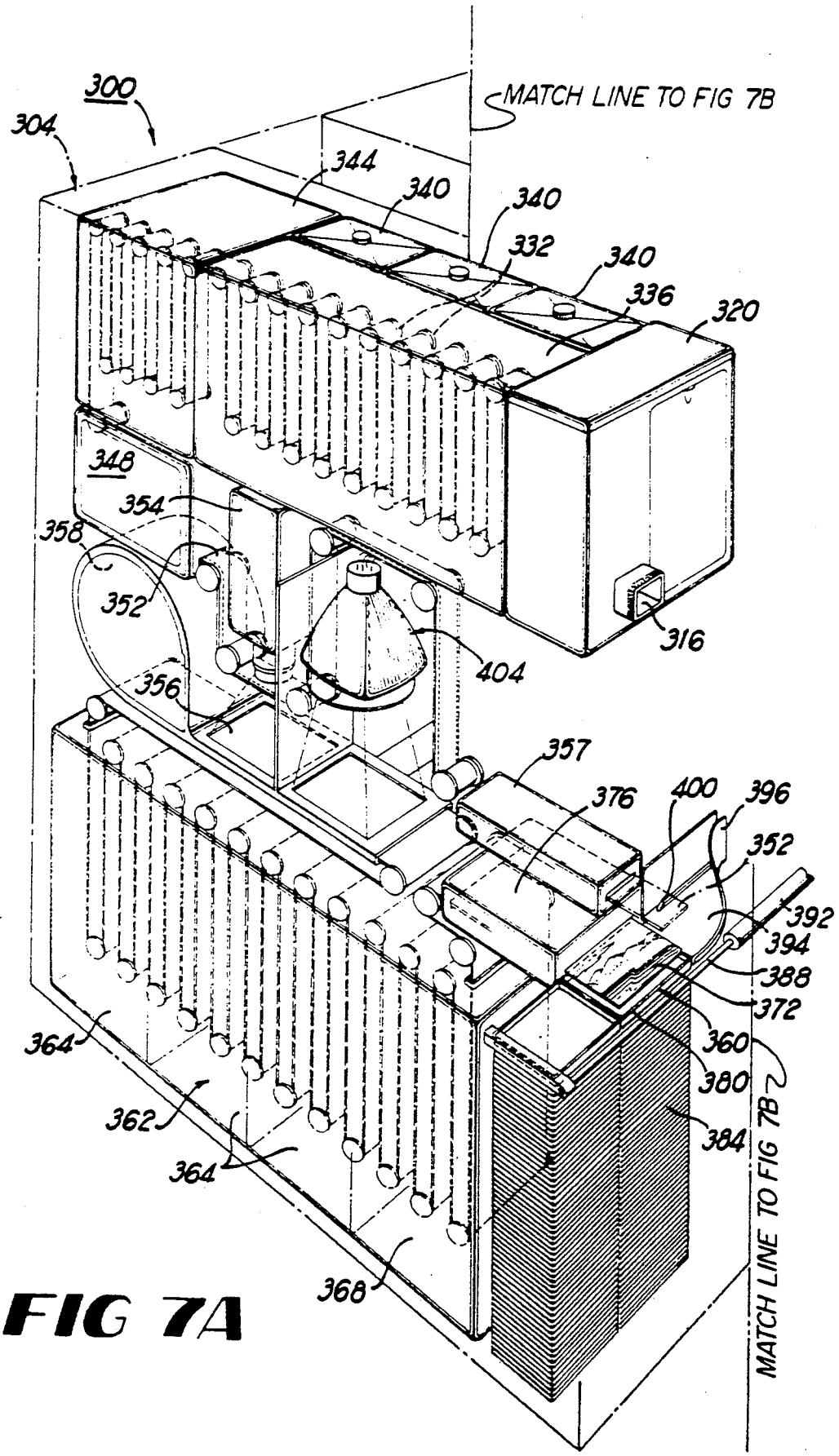
FIGS. 7A-B and 8 correspond, respectively, to FIGS. 5A-B and 2 of application Ser. No. 07/330,112.
Figure 7B:
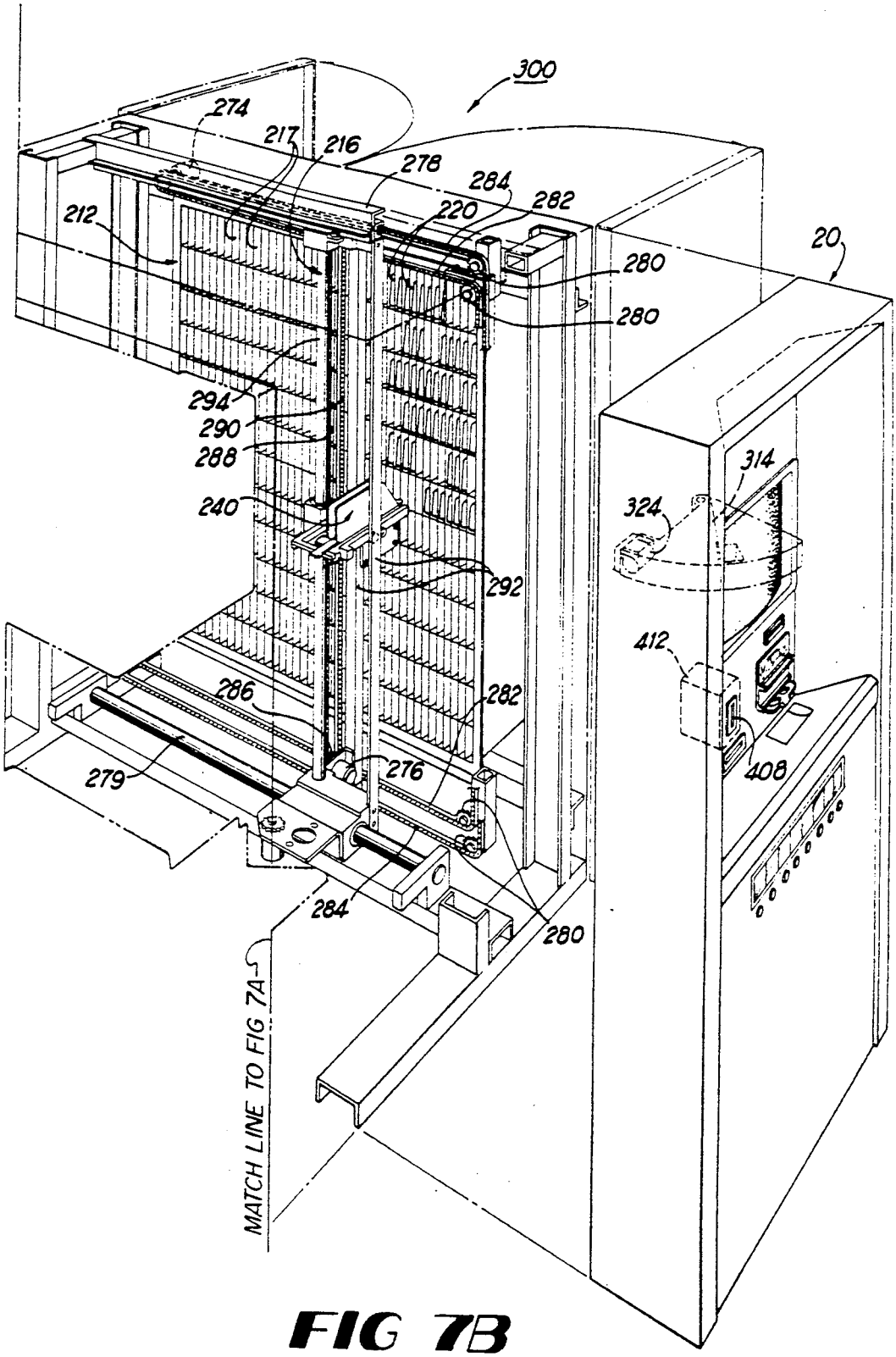
Figure 8:
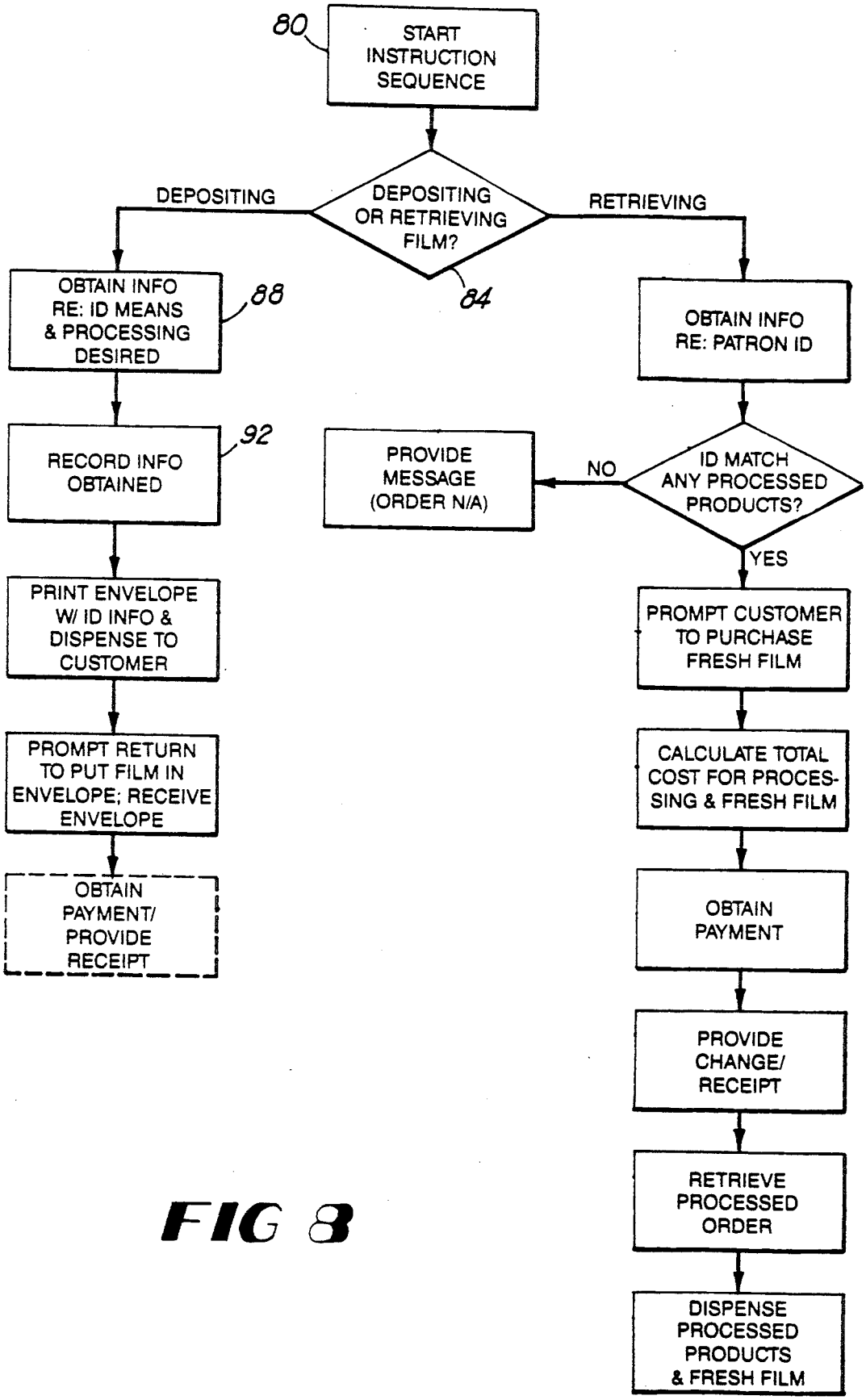

The present invention may be used in conjunction with the self-contained processing system described in application Ser. No. 07/330,112, which, as noted above, is incorporated herein in its entirety. According to that application (as revised for incorporation herein):

FIG. 7A–B is an exploded perspective view of an alternative self-contained processor system 300 of the present invention. Self-contained system 300 includes an automated film processing system 304 integrated with the apparatus 20 and controlled by a conventional digital computer, completely eliminating the need for direct human involvement in the handling and processing of the deposited items. Utilizing system 300 a patron may begin the deposit sequence as described in blocks 80–92 of FIG. 8 and deposit film products into apparatus 20 through a releasable door 314, a slot, or any other appropriate opening connected to an insertion slot 316 for opener 320. Opener 320 removes the film from its light-resistent cartridge and positions the spool of film 324 (corresponding to strip 14) on film transport mechanism 328, which includes a series of rollers 332 and a drive motor (not shown), for transport to the automated film processor 336, which includes containers 340 for storing processing chemicals, (one or more processing stations 10,) and dryer 34 for processing of the film 324. A color analyzer 348 determines the optimum printing requirements for each picture of the processed color negatives 352. The negatives 352 subsequently are transported to a film lamphouse 354, which optically projects the image contained on each negative 352 onto light-sensitive paper 356 supplied by paper roll 358 below. From the lamphouse 354 negatives 352 are transported to a film cutter 357 for cutting into standard size rows and to a packaging station 360 for sleeving in a plastic (or other) sleeve.

Similarly, paper 356 containing the projected images is transported to an automated processor 362, containing chemical storage bins 364, and dryer 368 for processing into positive prints 372. The paper 356 containing prints 372 is then conveyed to paper cutter 376 which slices the paper 356 into individual prints, and to packaging station 360, which transmits cost data to the computer and prepares the prints for packaging and labeling with its corresponding negatives 352 in a hinged container 380 supplied by magazine 384. Piston 388 of a computer-controlled cylinder assembly 392 then retracts, engaging the container 380 having the processed products and causing container 38 to close. As piston 388 continues to retract, container 380 is pulled along ramp 394, which is inclined so that container 380 is rotated ninety degrees, into shoe 396 to await storage. Scoop mechanism 240 subsequently is positioned adjacent to and slightly below shoe 396. The computer then actuates mechanical finger 400, which travels along the floor of shoe 396 and pushes container 380 out of shoe 396 and into scoop mechanism 240. The mechanism 240 transports container 380 to the vending portion of the integrated station for storage (as processed packages 220) in storage unit 212. Those skilled in the art will recognize that a number of cutting, packaging and transport methods may be used which differ from that described above. In particular, the cutting and packaging functions may be performed by a single device manufactured by the Standard Manufacturing Company.

The self-contained processing system 300 disclosed in FIG. 7A also contains a video imaging device 404, which may be a CRT, and associated optics for making prints from still video camera diskettes. Once a customer inserts the diskette into a slot 408 (FIG. 7B) added to the vending apparatus 20, the digital computer causes the information contained on the diskette to be read by a diskette reader 412 included in apparatus 20 and transmitted to the computer for display on video imaging device 404. The images derived from the transmitted information then are projected onto paper 356 supplied by paper roll 358. Paper 356 is conveyed to the automated processor 362 and dryer 368 for processing and transported to paper cutter 376 and packaging station 360 for cutting, packaging, and transporting to scoop mechanism 240 as described above. After being read by reader 412, the diskette may be returned to the customer immediately.

Automated processing system 300 includes a self-threading system of the type used in a minilab leader tab system. A suitable opener 320 for the film cartridges may be similar to a Standard Manufacturing Company "Twilight 135" automatic system. Color analyzer 348 typically is a light and color sensor of the type used in a "Noritsu 1201" printer. Lamphouse 354 is a computer-controlled light source and filter arrangement adjusted automatically from information obtained from the color analyzer 348 and is similar to the lamphouse of a "Noritsu 1201" printer. Finally, automated processors 336 and 362 may be rapid access processors, typically type C41, while diskette reader 412 typically is of a type similar to the Canon "RV-301" Still Video Player.

The foregoing is provided for purposes of illustration, explanation, and description of a preferred and alternate embodiment of the present invention. Modifications and adaptations to these embodiments will be apparent to those of ordinary skill in the art and may be made without departing from the scope or spirit of the invention.

We claim:

1. An apparatus for processing a photographic emulsion on the first surface of a substrate having opposed first and second surfaces, comprising:

a. a distendable material positioned for contact with the emulsion when the material is distended;

b. means for distending the material by delivering a photographic processing chemical through the material to the emulsion; and c. means, opposite the substrate from the distending means, for permitting the delivered photographic processing chemical to lubricate the second surface of the substrate.

2. An apparatus according to claim 1 in which the material is selected from the group comprising meshes and perforated polymer films.

3. An apparatus according to claim 2 in which the distending means comprises a first chamber for receiving and dispersing the photographic processing chemical, comprising:

a. a first cell having a periphery;
b. an inlet for receiving the photographic processing chemical within the cell; and
c. a lower surface comprising a first perforated sheet contacting the periphery of the first cell, for dispersing the chemical through the perforations.

4. An apparatus for processing a photographic emulsion comprising:

a. a distendable material positioned for contact with the emulsion when the material is distended;
b. means for distending the material by delivering a photographic processing chemical through the material to the emulsion, comprising:
   i. a first cell having a periphery;
   ii. an inlet for receiving the photographic processing chemical within the cell; and
   iii. a lower surface comprising a first perforated sheet contacting the periphery of the first cell, for dispersing the chemical through the perforations; and
c. a chamber opposed to the distending means, comprising:
   i. a second cell having a periphery; and
   ii. an upper surface comprising a second perforated sheet contacting the periphery of the second cell.

5. An apparatus for dispersing fluid onto a photosensitive material comprising:

a. a first chamber positionable above the photosensitive material comprising:
   i. a first cell having a periphery;
   ii. an inlet for receiving within the cell fluid to be dispersed; and
   iii. a lower surface comprising a perforated sheet contacting the periphery of the first cell, for dispersing fluid through the perforations;
b. a second chamber positionable below the photosensitive material comprising:
   i. a second cell having a periphery, which periphery is closely proximate the periphery of the first cell when the first and second chambers are positioned above and below the photosensitive material, respectively, for at least partially insulating fluid from the surrounding environment; and
   ii. an upper surface comprising a perforated sheet contacting the periphery of the second cell, for collecting dispersed fluid and allowing the fluid to pass into the second cell; and
c. a first foraminous material interposable between the lower surface of the first chamber and the photosensitive material, for dispersing fluid uniformly onto the photosensitive material.

6. An apparatus according to claim 5 further comprising a second foraminous material interposable between the upper surface of the second chamber and the photosensitive material, for collecting dispersed fluid and allowing the fluid to pass onto the upper surface of the second chamber.

7. An apparatus according to claim 6 in which the second chamber further comprises an outlet for allowing fluid to exit the second chamber.

8. An apparatus according to claim 7 further comprising means for conveying the photosensitive material to a position intermediate the first and second chambers.

9. An apparatus according to claim 8 in which the conveying means comprises a pair of counter-rotating nip rollers.

10. An apparatus according to claim 5 in which the lower surface of the first chamber is polyester film.

11. An apparatus according to claim 5 in which the lower surface of the first chamber is fluorinated polymer film.

12. An apparatus according to claim 11 in which one surface of the fluorinated polymer film is embossed with cross-hatching.

13. An apparatus for dispersing fluid onto a photosensitive material comprising:

a. a first chamber positionable above the photosensitive material comprising:
   i. a first cell having a periphery;
   ii. an inlet for receiving within the cell fluid to be dispersed; and
   iii. a distendable lower surface comprising a perforated polyester sheet contacting the periphery of the first cell, for dispersing fluid through the perforations;
b. a first foraminous material interposable between the lower surface of the first chamber and the photosensitive material, for dispersing fluid uniformly onto the photosensitive material;
c. a second chamber positionable below the photosensitive material comprising:
   i. a second cell having a periphery, which periphery is closely proximate the periphery of the first cell when the first and second chambers are positioned above and below the photosensitive material, respectively, for at least partially insulating fluid from the surrounding environment;
   ii. an upper surface comprising a perforated polyester sheet contacting the periphery of the second cell, for allowing fluid to pass into the second cell; and
   iii. an outlet for allowing fluid to exit the second cell;
d. a second foraminous material interposable between the upper surface of the second chamber and the photosensitive material, for collecting dispersed fluid and allowing the fluid to pass onto the upper surface of the second chamber; and
e. a pair of counter-rotating rollers for conveying the photosensitive material to a position intermediate the first and second chambers.

14. A method for processing photographic emulsion on the first surface of a flexible substrate having opposed first and second surfaces, comprising the steps of:

a. distending a material by charging it with a first photographic processing chemical;
b. contacting the emulsion with the distended material;
c. delivering the first photographic processing chemical to the emulsion; and
d. using the delivered first photographic processing chemical to lubricate the second surface of the substrate.

15. A method according to claim 14 further comprising the step of moving the substrate relative to the material.

16. A method according to claim 15 further comprising the step of contacting the emulsion with a material charged with a second photographic processing chemical.

17. A method according to claim 16 further comprising the steps of:

a. prompting a patron to provide information relating to the patron's identity;

b. recording the information provided on a memory means located within an unmanned apparatus;

c. prompting the patron to deposit a light-resistent cartridge containing the substrate into the unmanned apparatus and d. removing the substrate form the light-resistent cartridge.

18. A method according to claim 14 further comprising the step of positioning ht substrate intermediate opposing first and second chambers having matched peripheries, the first chamber containing the distendable material, for virtually sealing the positioned substrate from the environment surrounding the chambers.

19. A method for dispersing fluid onto a photosensitive material comprising the steps of:

a. positioning the photosensitive material intermediate opposing first and second chambers having matched peripheries for virtually sealing the positioned photosensitive material form the environment surrounding the chambers;

b. introducing fluid into and thereby distending the first chamber; and c. passing the fluid through a perforated section of the first chamber.

20. A method according to claim 19 in which the photosensitive material has opposed first and second surfaces, further comprising the steps of:

a. delivering the fluid to the first surface of the photosensitive material and b. using the delivered fluid to lubricate the second surface of the photosensitive material.

21. A method according to claim 19 further comprising the step of passing the fluid through a porous material.

22. An apparatus for dispersing fluid onto a photosensitive material comprising:

a. a first chamber positionable above the photosensitive material comprising:

i. a first cell having a periphery;

ii. an inlet for receiving within the first cell fluid to be dispersed; and iii. a distendable lower surface comprising a perforated sheet contacting the periphery of the first cell, for contacting the photosensitive material and dispersing fluid through the perforations; and b. a second chamber positionable below the photosensitive material comprising:

i. a second cell having a periphery, which periphery is closely proximate the periphery of the first cell when the first and second chambers are positioned above and below the photosensitive material, respectively, for at least partially insulating fluid from the surrounding environment; and ii. an upper surface comprising a perforated sheet contacting the periphery of the second cell, for collecting dispersed fluid and allowing the fluid to pass into the second cell.

23. A method for processing photographic emulsion on a flexible substrate comprising the steps of:

a. distending a material by charging it with a first photographic processing chemical;

b. contacting the emulsion with the distended material;

c. moving the substrate relative to the material and d. contacting the emulsion with a material charged with a second photographic processing chemical having a composition different than the first photographic processing chemical.

* * * * *

UNITED STATES PATENT AND TRADEMARK OFFICE

CERTIFICATE OF CORRECTION

PATENT NO. : 5,144,474

DATED : September 1, 1992

INVENTOR(S) : John B. Keable

It is certified that error appears in the above-identified patent and that said Letters Patent is hereby corrected as shown below:

Column 3, line 26, delete "2" and insert --25--

Column 3, line 42, delete "!0" and insert --10--

Column 4, line 3, delete "6" and insert --62--

Column 4, line 5, delete "10"

Column 4, line 54, delete "!0" and insert --10--

Column 5, line 41, delete "34" and insert --344--

Column 5, line 64, delete "38" and insert --380--

Column 7, line 35, after the word "the" insert --first--

Column 9, line 15, delete "ht" and insert --the--

Column 9, line 26, delete "form" and insert --from--

Signed and Sealed this

Twenty-eighth Day of September, 1993

*Attest:*

Bruce Lehman

BRUCE LEHMAN

*Attesting Officer*

*Commissioner of Patents and Trademarks*